US006354045B1

(12) United States Patent
Boone et al.

(10) Patent No.: US 6,354,045 B1
(45) Date of Patent: Mar. 12, 2002

(54) ROOF PANEL SYSTEM FOR IMPROVED WIND UPLIFT RESISTANCE

(76) Inventors: Mark Boone; Frank Resso; George Jones; Joseph Orlando; Bruce Boss, all of 2070 Steel Dr., Tucker, GA (US) 30083

( * ) Notice: Subject to any disclaimer, the term of this patent is extended or adjusted under 35 U.S.C. 154(b) by 0 days.

(21) Appl. No.: 09/518,513

(22) Filed: Mar. 3, 2000

(51) Int. Cl.[7] ..... E04B 7/00

(52) U.S. Cl. ..... 52/95; 52/528; 52/395; 52/520; 52/469

(58) Field of Search ..... 52/537, 763

(56) References Cited

U.S. PATENT DOCUMENTS

| | | | | | |
|---|---|---|---|---|---|
| 4,649,684 | A | * | 3/1987 | Petree | 52/395 |
| 4,870,798 | A | * | 10/1989 | Richter | 52/528 |
| 4,987,716 | A | * | 1/1991 | Boyd | 52/520 |
| 5,222,340 | A | | 6/1993 | Bellem | |
| 5,737,892 | A | * | 4/1998 | Greenberg | 52/469 |

* cited by examiner

*Primary Examiner*—Carl D. Friedman
*Assistant Examiner*—Steve Varner
(74) *Attorney, Agent, or Firm*—Hahn Loeser + Parks LLP; Stephen L. Grant

(57) ABSTRACT

A system for roofing a substructure has a plurality of roof panels, a plurality of support members and a plurality of cap members. The roof panels each have a horizontal channel section bounded on a pair of opposing side edges by side flanges, with an upper end of each side flange bent to provide a groove opening outwardly laterally from the panel. The support members each have a pair of oppositely extending base flanges and a pair of oppositely extending top flanges, the base flanges and top flanges being positioned along a vertical web member. The top flanges are adapted to be received in the groove of one of a pair of adjacent roof panels and one of the base flanges of each support member is adapted to fasten the support member to the substructure. The cap members have side walls to retain the top flanges in the grooves without fastening the roof panel to the support member, thereby allowing some relative movement upon deflection of the roof panel. The length of the support members allows a single support member to be fastened to each of a pair of spaced-apart substructural members, such as purlins.

19 Claims, 3 Drawing Sheets

ROOF PANEL SYSTEM FOR IMPROVED WIND UPLIFT RESISTANCE

The present invention relates to an improved roof panel system used on a building to provided increased resistance to wind uplift forces. Particularly, the invention relates to an improved roof panel system which provides increased wind uplift resistance through an improved panel support member which is used to join adjacent panels in a standing seam configuration. The support member of the present invention provides spanning, load-carrying and load-transferring capabilities which are not known in the prior art.

BACKGROUND OF THE INVENTION

Since about 1990, wind uplift has become an important consideration in the design of roofing systems. In fact, it has been reported that the amount of wind damage to roofs incurred this decade from hurricanes alone amounts to $27 billion. A rectangular roofing surface 100 as is generally known in the prior art is shown in FIG. 1. Such a roofing surface 100 may be broken up into a plurality of areas having distinct wind uplift requirements. A generally square area 102 located in each of the four corners has the highest demand put upon it by wind forces, and this area 102 is referred to as a "Zone 3" area. Each of the four Zone 3 areas 102 is bounded by two adjacent exterior side edges 104 and two interior side edges 106. The next highest area of wind uplift forces is a generally rectangular area 108 located along the intermediate portions of the roof edges between a pair of the Zone 3 areas. Each of these areas 108, which are also referred to as "Zone 2" areas, has one exterior side edge 110, a parallel, opposing, interior side edge 112, and a pair of opposed parallel side edges 106. These side edges 106 are, of course, shared with the adjacent Zone 3 area 102. The four Zone 3 areas 102 and the four Zone 2 areas 108 define the outside peripheral area of the roof surface 100 and their direct exposure to the wind forces places the higher demand upon them. The remaining roof surface area 114 is generally designated as "Zone 1" and it is bounded by two sets of opposed parallel sides 112. These sides 112 are shared by the Zone 1 area 114 and the four adjacent Zone 2 areas 108. It will be customary to lay roofing panels on a roofing surface area 100 in a manner that puts the panels either parallel to or perpendicular to these edges, rather than placing them obliquely.

A typical standing seam roof panel system of the type known in the prior art is taught in U.S. Pat. No. 4,649,684, to Petree, et al., which is commonly owned with the present invention. Petree '684 teaches a panel system for joining adjacent panels, using a plurality of spaced-apart bent metal clips which are aligned along the standing wall portions of adjacent panels to affix the panels to a building substructure. These clips bear the heavy burden of withstanding the wind uplift forces imposed in service. The surfaces which bear the majority of those forces are a base portion which extends laterally out from one side of the bottom of a connecting wall portion and a plurality of tab portions which project laterally outward from the top of the connecting wall portion. Each of the Petree '684 clips, as will be explained in more detail below, is affixed to the building substructure only through a single fastener. Unless any adjacent Petree '684 clips are affixed to the same piece of substructure, they are absolutely unable to transfer any load-bearing capability between them, other than through a roof panel shared by both clips, which is an untenable solution. While the Petree '684 clips are efficacious, it is necessary to place them on much closer spacings in the Zone 3 and Zone 2 areas than in the Zone 1 area of a roof in order to provide a roof which will resist wind uplift. In some applications, it is simply not possible to place the Petree '684 clips sufficiently close together to comply with wind-uplift resistance requirements.

It is therefore an advantage of the present invention to provide an improved roofing panel system where clips of the type known in the prior art may be used in some areas, such as Zone 1, but a novel support member possessing capabilities far beyond those of the prior art may be used in association with the roofing panels in Zones 3 and/or 2 to increase the wind uplift resistance.

SUMMARY OF THE INVENTION

This advantage of the present invention is provided by a system for roofing a substructure. The system comprises a plurality of roof panels, a plurality of support members and a plurality of cap members. Each of the roof panels comprises a horizontal channel section bounded on opposing edges by a pair of side flanges. An upper end of each side flange is bent to provide a groove which opens outwardly laterally from the panel. Each of the support members has a pair of oppositely extending base flanges and a pair of oppositely extending top flanges. These base flanges and top flanges are positioned along a vertical web member. Each of the top flanges is adapted to be received in the groove of one of a pair of adjacent roof panels. At least one of the two base flanges is adapted to fasten the support member to the substructure. The plurality of cap members have side walls for retaining the top flanges in the grooves. In this way there is no direct fastening of the roof panels to the substructure, so that relative movement is permitted. The top flanges effectively bear the weight of the roof panels. In some embodiments, the support members further comprise a pair of oppositely extending shelf members, one on each side of the vertical web, so that each shelf member is positioned below the channel section of one of the roof panels when the top flange is received in the groove, such that the shelf member bears weight of the roof panel only when the roof panel is deflected, but the shelf member also acts to delimit deflection of the panel side wall.

This advantage of the invention is also achieved through a method for providing a roofing system for a substructure. The method is comprised of several steps. The first step is placing a first roof panel as described above onto the substructure such that one of the side flanges and its groove is exposed. This is followed by the step of placing a first support member as described above adjacent to the first roof panel so the vertical web member is adjacent to the exposed side flange. This allows one of the top flanges to be received in the exposed groove and to bear the weight of the first roof panel onto the top flange. This support member is then fastened to the substructure through an exposed base flange of the pair base flanges which is adapted for fastening, for example, as with having a fastener receiving hole therethrough. A second roof panel, also as described above, is placed adjacent to the first support member so that the groove on the side flange adjacent to the first support member receives the remaining top flange of the first support member to bear the weight of the first roof panel onto the top flange. This leaves the second side flange and its associated groove on the second roof panel exposed. The first support member has now received the bearing weight of two roof panels, and a cap member is placed onto the junction of the top flanges of the support member and the grooves of the two roof panels. The cap member joins the roof panels at the first support member without direct fastening to the substructure by the roof panels. The exposed side wall and groove of the second roof panel are then joined to the roof through a second support member in the manner described above. This process may be repeated a sufficient number of times with additional roof support members, roof panels and cap members to cover the substructure.

BRIEF DESCRIPTION OF THE DRAWINGS

A better understanding of the present invention will be had when reference is made to the accompanying drawings, wherein identical parts are identified by identical reference numerals and wherein.

DETAILED DESCRIPTION OF THE PREFERRED EMBODIMENT

Figure 1:
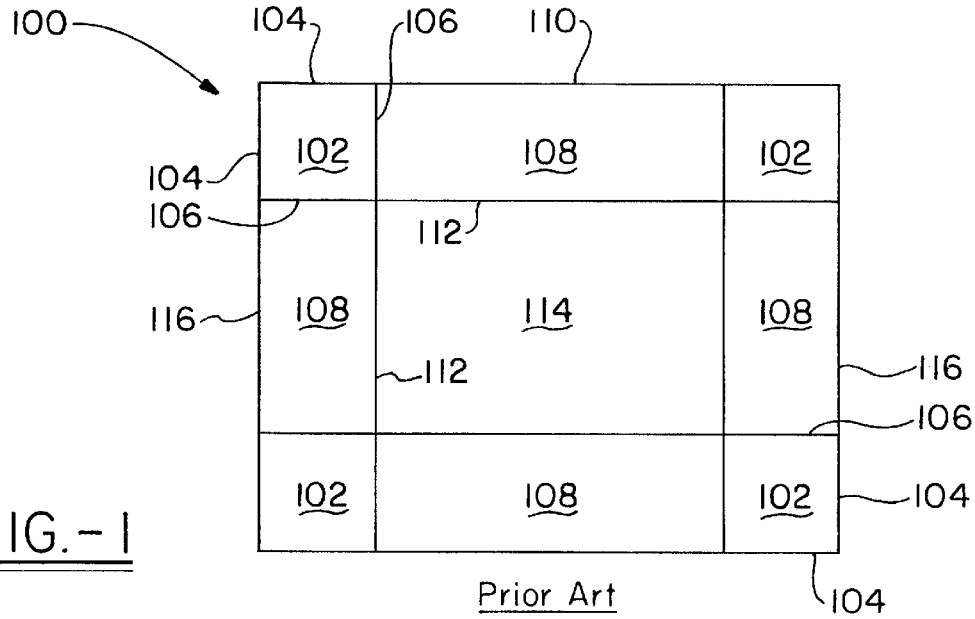
FIG.-1 Prior Art
FIG. 1 shows a schematic depiction of a plan view of a roof surface, showing various wind uplift classification zones.

FIG. 1 provides a general schematic plan view of a rectangular roofing surface 100 designating the wind uplift zones 102, 108 and 114 as described in more detail above in the Background of the Invention. Edges of these zones are designated as 104, 106, 110 and 112, also as described in more detail above.

Figure 2:
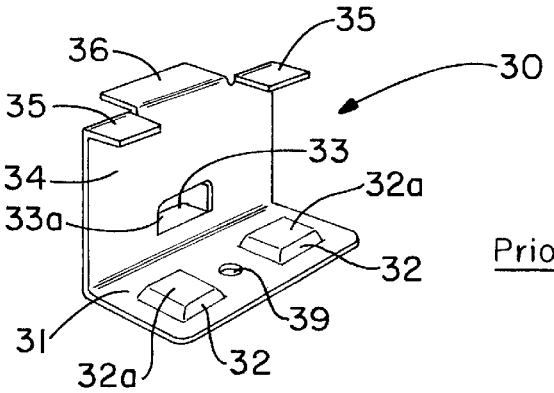
FIG.-2 Prior Art
FIG. 2 shows an perspective view of a clip as known in the prior art.

FIG. 2 shows a clip 30 of the type taught in Petree '684. A plurality of these clips 30 provide a means for anchoring a roof panel system to a building substructure. The clip 30 is made from sheet metal, particularly sheet steel, and may be bent into position from a planar sheet of the metal using conventional metal forming techniques. In the embodiment shown, a base 31 is formed at one end of a connecting wall 34, typically by bending a flap along a bottom edge of a planar metal blank used for forming the clip. The base 31 has a pair of raised portions 32, a flat top surface 32*a* upon which a bottom surface of a roof panel may rest upon or be contiguous to in a spaced-apart relationship from the building substructure. An aperture 39 in the base 31 allows a fastener, typically a screw, to attach the clip 30 to building substructure. Base 31 extends perpendicularly outwardly from only one side of connecting wall 34. However, a second roof panel will be held in place on the opposite side of the clip from base 31. Therefore, a struck-out tongue 33 of the connecting wall 34 is provided so that this tongue 33 can act in a similar fashion to raised portions 32*a*, although on the opposite side of the clip. Across the top end of connecting wall 34, tabs 35, 36 and 37 are bent perpendicularly outwardly from the connecting wall so that they are all substantially parallel to base 31. These tabs 35, 36, 37 alternate in direction, so that the example shown in FIG. 2 has tabs 35 and 37 extending in the same direction as base 31, while tab 36 extends in the opposite direction. These tabs 35, 36 and 37 provide a member for insertion into a groove on a side flange of the respective roof panels. It is these tabs 35, 36 and 37 which engage and provide the majority of support to the roof panels.

Figure 3:
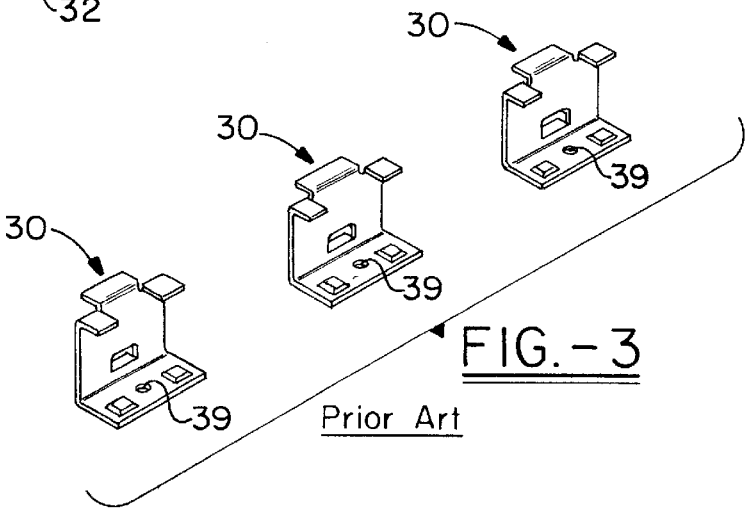
FIG.-3 Prior Art
FIG. 3 shows a line of the clips of FIG. 2 as used to provide a roof fastening system.

As is shown in FIG. 3, it is typical to position clips 30 in a spaced-apart row so that they may each be used to support roof panels of the type taught by Petree '684, which will be further shown and described below. Actually, in isolation, FIG. 3 is somewhat deceptive in a few manners. First, it implies that the clips 30 are laid out on the building substructure and fastened into position before the roof panels are in place. In fact, the first of the two roof panels has already been set into position, and the panel terminates along its edge with a side flange, which extends perpendicularly upwardly from a horizontal channel. The top of the side flange has the groove formed from a bending of the side flange metal. With this first panel in place, a clip 30 is abutted to the side flange, so that tongue 33 slides under the horizontal channel and tab 36 fits into the groove. Since base 31 extends outwardly away from the panel, aperture 39 may be used to fasten the clip 30 down to the building substructure. Such clips 30 are fixed to the first panel in spaced-apart intervals in the manner shown in FIG. 3. A second possible misperception from the line of clips 30 is that they are aligned along a common support structure, such as a roof purlin or the like and that the exact spacing of the clips will be determined by amount of wind uplift resistance needed. Because the purlins in a roof structure are relatively narrow and may be spaced significantly apart from each other, as with many other structures in the building substructure, the almost continuous chain or sequence of clips 30 which would seem to be needed in a Zone 3 area may simply not be possible. A clip 30 is only useful when it has a substructure immediately below it to which it may be fastened. With only one aperture 39 for fastening the clip to a substructure, the clip 30 cannot be said to "span" from one substructural element to another.

Once the entire side edge of the first panel has been fixed to the building substructure by clips 30, a second roof panel is positioned along the line of clips just installed, so that a side flange on the second panel abuts against the side of connecting wall 34 from which base 31 extends. Raised portions 32*a* slide under, and support, the horizontal channel of this second panel and tabs 35, 37 on each of the clips 30 fit into the groove at the top of the side flange. Because the manner in which the first and second panels and the clips are fitted together, there is a great amount of accommodation provided for thermal expansion and contraction, as well as movement to dissipate wind-imposed stresses, including uplift forces. A cap member is placed over respective side flanges and the clip 30 at the area where the tabs 35, 36, 37 fit into the grooves. This covers and seals the gap provided between roof panels, rendering the roof surface so formed sealed and secured, although the cap member never actually touches the clip 30.

While the clips 30 of Petree '684 are certainly effective and useful, particularly in Zone 1 areas of a roof, the simplicity provided by the bent metal forming of the clips does not allow for advantages which can be provided by an improved support member, which is the focus of the present invention.

Figure 4:
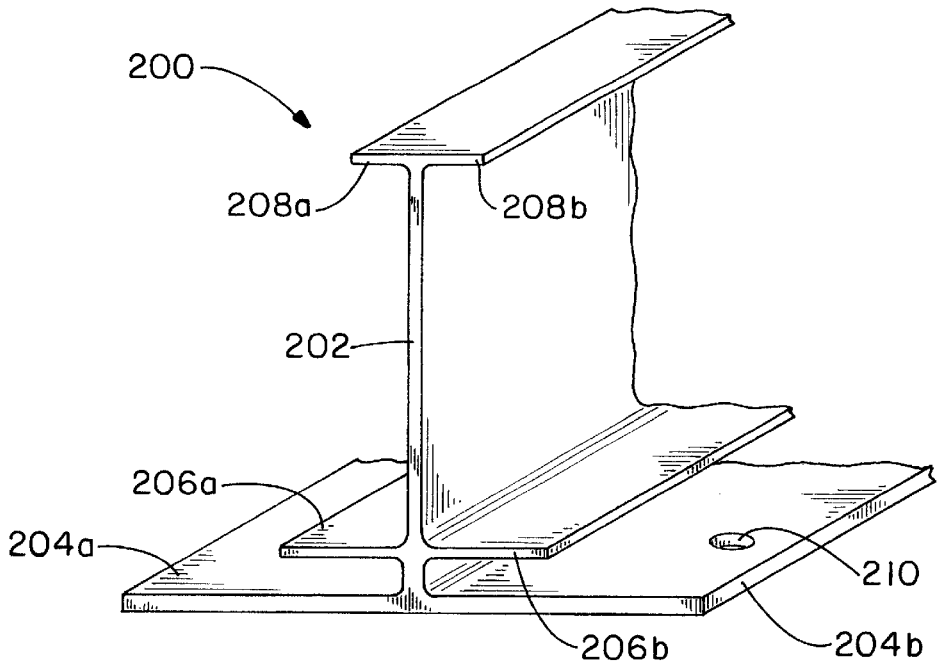
FIG. 4 shows a perspective view of a portion of a support member of the present invention.

FIG. 4 reveals an enlarged perspective view of a portion of a first embodiment 200 of the support member of the present invention. This support member 200 is preferably formed from an extruded metal in the same manner as an I-beam, although obviously in a thinner wall thickness. The support member 200 has a continuous vertical web member 202, which is not interrupted by cut outs such as the struck-out tongue 33 in clip 30. Along a bottom edge of vertical web member 202, a pair of horizontal base flanges 204*a*, 204*b*, extend outwardly from each side of the web member. Above this bottom edge, but still low on the vertical web member 202, a pair of shelf members 206*a*, 206*b*, extend outwardly parallel to the base flanges 204. At the top edge of the vertical web member 202, a pair of top flanges 208*a* and 208*b* are formed.

Base flanges 204*a* and 204*b* each extend laterally away from the vertical web member much farther than shelf members 206*a*, 206*b*. A series of apertures 210 (only one is shown in FIG. 4) may be punched or otherwise formed along at least one of the base flanges 204*a*, 204*b*. These apertures 210 are useful for insertion of fasteners, as with apertures 39 of clip 30, to fasten the support member 200 to an element of building substructure. The top flanges 208 will typically be parallel to base flanges 204, although in some applications it may be preferred to bend the top flanges downwardly somewhat into a "chevron" cross-sectional shape.

One important difference between clip 30 and improved support member 200 is that all flanges (including shelf members 206) provided on support member 200 are continuous rather than discontinuous and that the base flanges 204 provide support on each side of vertical web member 202. These continuous flanges have the advantages of reinforcing the vertical web member 202, as well as limiting deflection of the roof panels along the entire length of the roof panel. Individual clips 30 which do not interact or mutually support each other lack this functionality.

Figure 5:
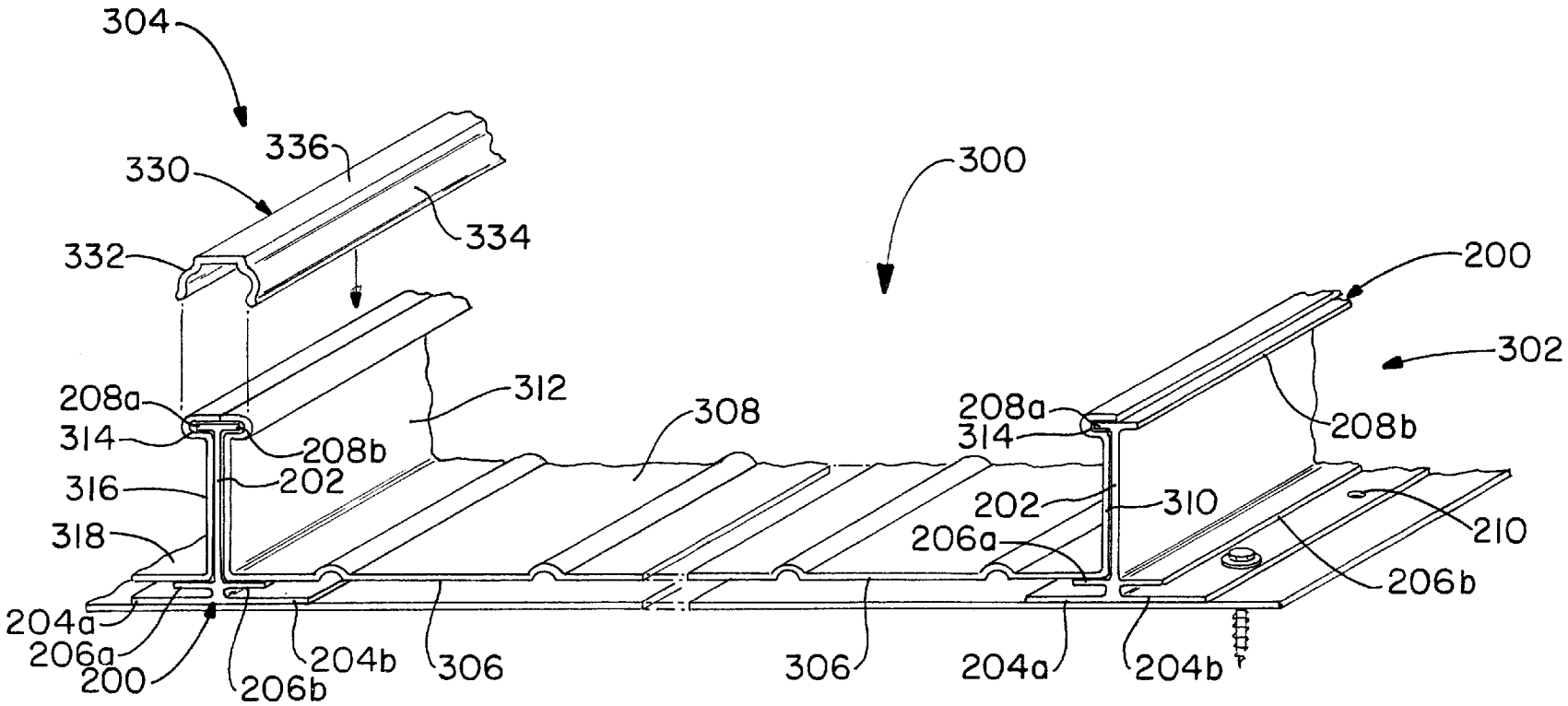
FIG. 5 shows, in perspective view, both a partially installed roof seam and a completed roof seam using the support member of the present invention.

The manner of installing a roof system using support member 200 is analogous to that used for clip 30. Instead of installing a series of clips 30, however, a single continuous length of support member 200 is used. Reference is now made to FIG. 5, which shows both a standing seam type roofing system 300, with a partially installed roof seam as well as a completed roof seam. In FIG. 5, the installation has been made from left to right, so the rightmost seam, generally shown as 302, is the partial or uncompleted standing seam, while the leftmost seam, generally shown as 304, is completed. Focusing on seam 302, support member 200 is shown in abutting relationship to a roof panel 306 having a horizontal channel section 308 bounded on the right side by a first side flange 310 and on the left side by a second side flange 312. The first side flange 310 is bent at its upper end to provide a groove 314. This groove 314 opens laterally outwardly from panel 306. Support member 200 is abutted to the first side flange 310, with base flange 204*a* being seated on the building substructure directly under panel 306 and with the base of the first side flange 310 being contiguous to shelf member 206*a*, it being understood that the majority of weight-bearing is accomplished at the top flange 208*a* rather than at shelf member 206*a*. Top flange 208*a* fits into groove 314. Since base flange 204*b* extends outwardly away from first panel 306, apertures 210 are exposed and are used to fasten the support member 200 down to the building substructure. While FIG. 5 shows a single length of support member 200, and this is the clearly preferred embodiment for most applications, the extruded metal comprising the support member can be cut into sections, which are then subsequently installed in spaced-apart relationship.

Referring now to the leftmost seam 304 now, completion of the seam will be taught. At this seam 304, the second flange 312 of panel 306 has been positioned against an identical support member 200 after the support member 200 has been installed in an abutting relationship against a roof panel 316 having a horizontal channel section 318 bounded on the right side by a first side flange 320, the left side of the panel not being shown. The first side flange 320 of panel 316 is bent at its upper end to provide a groove 324, which opens laterally outwardly from panel 316. When support member 200 is abutted to the first side flange 320, with base flange 204*a* being seated on the building substructure directly under panel 316 and with the base of the first side flange 320 resting atop shelf member 206*a*, top flange 208*a* fits into groove 314. Support member 200 has been fastened to the substructure. As the second flange 312 of panel 306 is positioned along support member 200, base flange 204*b* rests under the panel 306 and the base of side flange 312 is contiguous to shelf member 206*b*, with the top flange 208*b* fitting into groove 324. A cap member 330 has side walls 332, 334 connected by a web 336. The side walls 332, 334 are shaped so as to be snapped into place atop the juncture of the panels 306, 316 at the clip. The lower surface of the web 336, that is, the surface which is inside the side walls 332, 334 may be provided with a sealant, such as a resilient elastomeric strip or a bead of mastic material. It is important to note that this mastic or elastomeric material does not directly contact the support member 200. Side walls 332, 334 may be fitted to a desired degree of tightness about the juncture. In some embodiments, it may be desirable to use a second cap member placed atop the first cap member 330. It will be recognized that this connection of the top flange 208*a* into the groove 314 (as well as the connection of top flange 208*b* into groove 324) allows a limited amount of movement of the roof panel in two directions relative to the support member and a relatively free movement in the third direction, that being the axis of the top flange.

In addition to the advantages explicitly mentioned above, some other advantages are provided by the present invention roof panel system utilizing an support member. Although base flange 204*a* is not directly fastened to the building substructure, since the fastener passes through base flange 204*b*, the integral nature of base flange 204 adds force-bearing area and also prevents forces acting on the upstanding web member 202 from being a lever arm to pry the fastener out of aperture 39, in the way that a force acting against web member 34 of the prior art clip 30 can use the bend which forms base 31 as a fulcrum of such a lever. The continuity of the vertical web 202 adds strength. This strength is enhanced by the continuity of outwardly extending flanges 204, 206 and 208. The continuity of flanges 206 and 208 provide a more stable seat for the adjacent roof panels to which they are affixed. The continuity of base flange 204*b* between fastener apertures 210 also strengthens the support member 200 against longitudinal bending moments.

Figure 6:
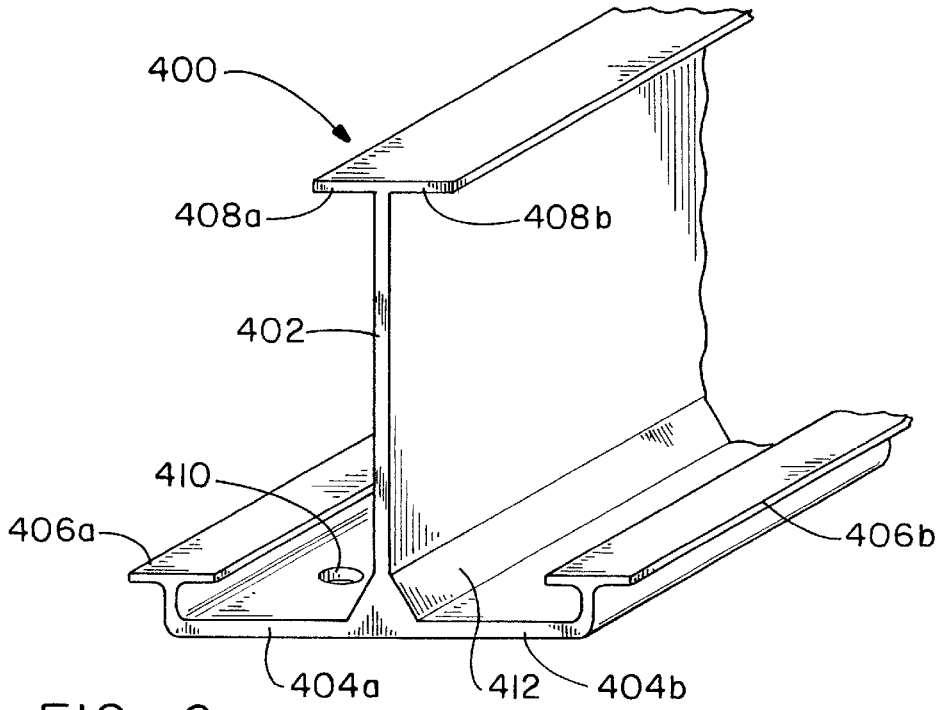
FIG. 6 shows a perspective view of a portion of a second embodiment support member of the present invention.

FIG. 6 shows a second or alternate embodiment 400 of the support member of the present invention. This second embodiment 400 is preferably formed from an extruded metal in the same manner as the first embodiment 200. The support member 400 has a continuous vertical web member 402. At a bottom edge of vertical web member 402, a pair of horizontal base flanges 404*a*, 404*b*, extend outwardly from each side of the web member. At the distal end of each of these base flanges 404 is a shelf member 406, shelf member 406*a* being on base flange 404*a* and shelf member 406*b* being on base flange 404*b*. At the top edge of the vertical web member 402, a pair of top flanges 408*a* and 408*b* are formed and extend outwardly.

Base flanges 404*a* and 404*b* each extend laterally away from the vertical web member 402 much farther than the width of either shelf member 406*a* or 406*b*, so a series of apertures 410 may be punched or otherwise formed along at least one of the base flanges 404*a*, 404*b*. These apertures 410 are useful for insertion of fasteners, as with apertures 39 of clip 30. The top flanges 408 will typically be parallel to base flanges 404, although in some applications it may be preferred to bend the top flanges downwardly somewhat into a "chevron" cross-sectional shape. A preferred embodiment of this second embodiment 400 also includes a broadened fillet-type cross-section 412 at the junction of base flanges 404 with vertical web member 402.

It will be readily understood that this second embodiment support member 400 would be useful as a means for fastening roof panels to a building substructure in exactly the same manner as support member 200 is shown in FIG. 5.

A further advantage of the support members 200 or 400 of the present invention is obtained when the roofing panels are installed in a manner such that the side flanges, like 310, run across the roof surface substantially perpendicularly to a set of parallel roof purlins or other linear substructural members. As is well known, these purlins or other substructural members will be three or more feet apart from each other. When the clip 30 of the prior art is used, there is no spanning capacity provided between adjacent purlins by the clips 30, other than the undesired burden placed on the roof panels. However, when a support member such as 200 or 400 is used, it effectively becomes an additional grid element in supporting and strengthening the roof, particularly in limiting deflection of the roof panels.

It will be readily recognized that the load transferring capabilities of the support member 200 or 400 will be equally applicable to both "positive" and "negative" pressures imposed on the roof panels, corresponding to upward and downward forces.

Support members 200 and 400 of the present invention are rigidly affixed only to the building substructure. There are no fasteners or the like passing through the roof panels and into the web member, the respective shelf members, the base flanges or the top flanges. This permits a great amount of ability to dissipate thermal expansion or wind forces through sliding motion of the panels relative to the support members.

It will also be recognized that the support members of the present invention, which effectively provide a linear anchor for a roof panel rather than a "point" anchor, will be useful with other types of roof panels in which the sliding engagement of the support member with the roof panel may be employed, rather than being limited only to use with the specific roof panels described above.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A system for roofing a substructure, comprising:

a plurality of roof panels, each of the roof panels having a horizontal channel section and a pair of opposed side flanges, an upper end of each side flange bent to provide a groove opening outwardly laterally from the panel;

a plurality of support members, each of the support members having a pair of coplanar, oppositely extending base flanges and a pair of oppositely extending top flanges, the base flanges and top flanges positioned along a vertical web member, each of the top flanges being adapted to be received in the groove of one of a pair of adjacent roof panels and one of the base flanges adapted to fasten the support member to the substructure; and a plurality of cap members with side walls for retaining the top flanges in the grooves.

2. The roofing system of claim 1 wherein the top flanges effectively bear the weight of the roof panels.

3. The roofing system of claim 1 wherein the support members further comprise a pair of oppositely extending shelf members, one on each side of the vertical web so that each shelf member is positioned below the channel section of one of the roof panels when the top flange is received in the groove, such that the shelf member bears weight of the roof panel only when the roof panel is deflected.

4. The roofing system of claim 3 wherein the pair of oppositely extending shelf members extend outwardly from the vertical web member between the base flanges and the top flanges.

5. The roofing system of claim 3 wherein the pair of oppositely extending shelf members are affixed to the pair of the base flanges so that the shelf members are vertically between the base flanges and the top flanges.

6. The roofing system of claim 3 wherein the top flanges and the shelf member of each of the support members co-act to effectively delimit deflection of the side flanges to which the support member is fastened with one of the cap members.

7. The roofing system of claim 1 wherein the vertical web member of each support member is continuous.

8. The roofing system of claim 1 wherein the top flanges of each support member is continuous.

9. The roofing system of claim 1 wherein the base flange which is not adapted to fasten to the substructure is continuous.

10. The roofing system of claim 1 wherein the substructure comprises a plurality of spaced-apart structural members and at least one of the plurality of support members is adapted to be fastened to at least two adjacent spaced-apart structural members.

11. A system for roofing a substructure, comprising:

a plurality of roof panels, each of the roof panels having a horizontal channel section and a pair of opposed side flanges, an upper end of each side flange bent to provide a groove opening outwardly laterally from the panel;

a plurality of support members, each of the support members having a pair of oppositely extending base flanges and a pair of oppositely extending top flanges, the base flanges and top flanges positioned along a vertical web member, each of the top flanges being adapted to be received in the groove of one of a pair of adjacent roof panels and one of the base flanges adapted to fasten the support member to the substructure; and a plurality of cap members with side walls for retaining the top flanges in the grooves;

wherein the support members further comprise a pair of oppositely extending shelf members, one on each side of the vertical web so that each shelf member is positioned below the channel section of one of the roof panels when the top flange is received in the groove, such that the shelf member bears weight of the roof panel only when the roof panel is deflected.

12. The roofing system of claim 11 wherein the top flanges effectively bear the weight of the roof panels.

13. The roofing system of claim 11 wherein the pair of oppositely extending shelf members extend outwardly from the vertical web member between the base flanges and the top flanges.

14. The roofing system of claim 11 wherein the pair of oppositely extending shelf members are affixed to the pair of the base flanges so that the shelf members are vertically between the base flanges and the top flanges.

15. The roofing system of claim 11 wherein the top flanges and the shelf member of each of the support members co-act to effectively delimit deflection of the side flanges to which the support member is fastened with one of the cap members.

16. The roofing system of claim 11 wherein the vertical web member of each support member is continuous.

17. The roofing system of claim 11 wherein the top flanges of each support member is continuous.

18. The roofing system of claim 11 wherein the base flange which is not adapted to fasten to the substructure is continuous.

19. The roofing system of claim 11 wherein the substructure comprises a plurality of spaced-apart structural members and at least one of the plurality of support members is adapted to be fastened to at least two adjacent spaced-apart structural members.

* * * * *